United States Patent [19]

Mullin et al.

[11] Patent Number: 4,948,084

[45] Date of Patent: Aug. 14, 1990

[54] SELF SEALING CONTAINER

[75] Inventors: Howard R. Mullin, Atherton, Calif.; Thomas R. Leonard, 947 Calle Los Aceitunos, Camarillo, Calif. 93010

[73] Assignee: Thomas R. Leonard, Camarillo, Calif.

[21] Appl. No.: 800,444

[22] Filed: Nov. 21, 1985

[51] Int. Cl.[5] ..... F16M 13/00

[52] U.S. Cl. ..... 248/523; 525/222

[58] Field of Search ..... 248/523, 519; 523/222

[56] References Cited

U.S. PATENT DOCUMENTS

| | | | |
|---|---|---|---|
| 2,039,401 | 5/1936 | Foges . | |
| 2,893,668 | 7/1959 | Applegate | 248/523 X |
| 3,033,505 | 5/1962 | Brown | 248/523 X |
| 3,182,101 | 5/1965 | Rees . | |
| 3,272,462 | 9/1966 | Apple | 248/523 X |
| 3,350,043 | 10/1967 | Apple | 248/523 X |
| 3,644,254 | 2/1972 | Dew . | |
| 3,663,663 | 5/1972 | McAda . | |
| 3,784,668 | 1/1974 | Neidinger . | |
| 3,820,749 | 6/1974 | Leonard et al. . | |
| 3,911,185 | 10/1985 | Wright, Jr. . | |
| 3,932,563 | 1/1976 | Argurio et al. . | |
| 4,243,576 | 1/1981 | Fischer et al. . | |
| 4,445,562 | 5/1974 | Bohm et al. . | |
| 4,547,413 | 10/1985 | Lustig et al. | 325/222 X |

*Primary Examiner*—Ramon S. Britts
*Assistant Examiner*—Sarah A. Lechok
*Attorney, Agent, or Firm*—Christie, Parker & Hale

[57] ABSTRACT

A method and apparatus is provided for holding a tree erect while supplying the tree with water. A container that comprises a blend of ethylene-vinyl acetate and high density polyethylene is molded. The bottom of the trunk of the tree is placed adjacent to the inside bottom of the container. A tree support, such as a pair of wooden cross-members, is placed adjacent the outside bottom of the container so that at least a portion of the tree support is in registry with the tree trunk bottom. Fasteners, such as nails, are driven through the tree support, through the container bottom and into the tree trunk. This fastens the tree securely to the container and tree support. The material of the container seals the openings around nails to thereby prevent water leakage from the container.

16 Claims, 1 Drawing Sheet

SELF SEALING CONTAINER

FIELD OF THE INVENTION

This invention relates to a new and useful container for supporting a tree in a vertical or erect position while providing water for the tree. The container is made of a polymeric composition which provides a self-sealing feature to the container. Thus, when the container is punctured by a nail or other like device which is used to support the tree, the polymeric composition of the container flows around the nail to provide a water tight seal.

BACKGROUND OF THE INVENTION

At Christmas time a large number of trees are purchased for display in the home or in schools, or hospitals or offices or the like. In most cases the trees have been cut and thus, they tend to dry out as the Christmas season progresses. A dry tree becomes a potential fire hazard and can be ignited by a spark or by lights which are commonly placed on the tree for decoration.

A tree used for display during the Christmas season can be kept from drying out if its trunk is placed in water. In order to do this, a tree stand has been developed which consists of a watering bowl having a metal ring supported by extensions from the sides of the bowl so that a tree, which has its trunk inserted into the ring, can be held in a vertical position.

There are, however, several disadvantages to the use of the above described tree stand. The diameter of the metal ring limits the size of the tree trunk which can be accommodated. (Trees with trunk diameters bigger than the ring diameter will not fit.) Conversely, trees with trunk diameters which are much smaller than the ring diameter may not have the desired degree of stability and may not stand vertically. Further, it is usually necessary to cut off all of the tree branches below the ring so that the tree can be inserted into the ring. Cutting branches from the tree detracts from its beauty.

U.S. Pat. No. 3,820,749 describes a tree stand that was developed to overcome the aforementioned difficulties associated with tree stands that include metal ring structures. The tree stand described in U.S. Pat. No. 3,820,749 includes a container that has a center portion which registers with the tree trunk when the tree is mounted in the container. The center portion is made of a material that can be penetrated by nails, but which, after penetration, reseals around the nails to prevent water leakage.

For example, in one embodiment, the sealant is on the outside of the container at the center of its bottom and opposite the location where the tree trunk abutts the inside of the container. A pair of crossed wooden members or boards are placed into position below the container with the intersection of the crossed members in registry with the sealant. A number of long nails are then hammered through the crossed members, through the sealant, and thence through the base of the container into the trunk of the tree. The combination can then be placed in an upright position with the supporting members holding the tree erect. The sealant operates to close the openings in the base of the container around the nail holes so that water that is placed into the container to keep the tree moist does not leak out. As a result, the tree is maintained in a vertical position while water is being absorbed by the tree.

There is, however, a need in the art for an improved tree stand container made in its entirety of a polymeric composition that will seal around a nail regardless of the location of the nail in the container.

SUMMARY OF THE INVENTION

This invention relates to a self sealing container that is useful for holding a tree erect while supplying the tree with water. The container is a uniform composition comprising a blend of ethylene vinyl acetate and high density polyethylene. Preferably the blend comprises from about 5% to about 60% by weight ethylene-vinyl acetate. Additionally it is preferred that the ethylene-vinyl acetate include from 10% to about 30% by weight vinyl acetate.

BRIEF DESCRIPTION OF THE DRAWINGS

These and other features, aspects, and advantages of the present invention will become more apparent when considered with respect to the following description, appended claims, and accompanying drawings wherein:

DETAILED DESCRIPTION

Figure 1:
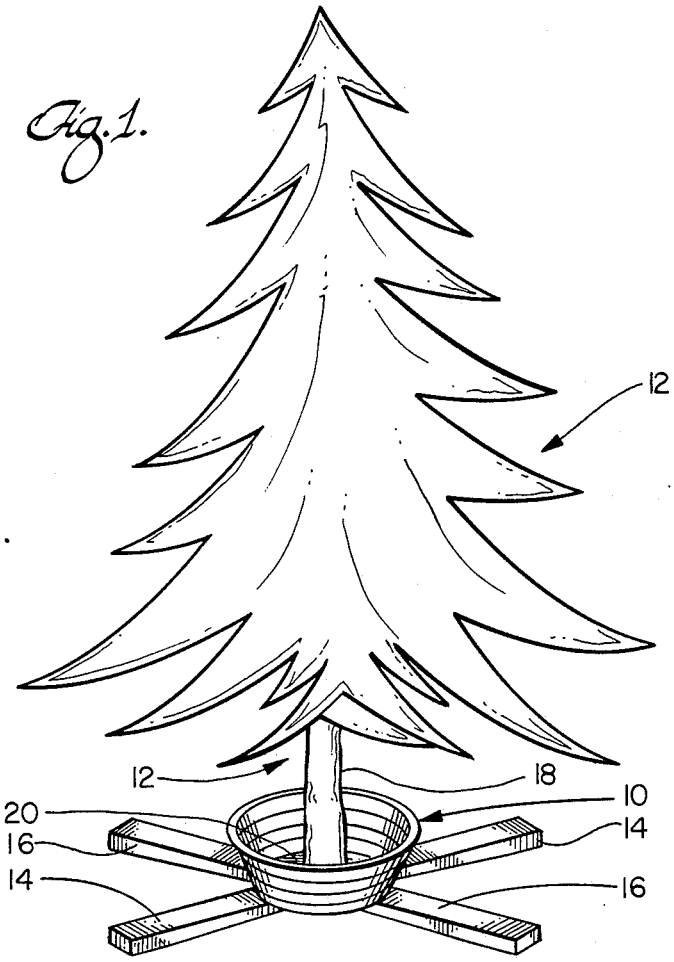
FIG. 1 is a semi-schematic perspective view showing one embodiment of the present invention in use.

Referring to FIG. 1, there is shown a preferred embodiment of a self-sealing container 10 provided in accordance of practice of principles of this invention. In its intended use, a Christmas tree 12 is mounted in a vertical position in the container. A pair of wooden cross-members or boards, 14 and 16 respectively, are affixed to the container and to the tree to thereby hold the container and tree in a vertical or upright position.

Figure 2:
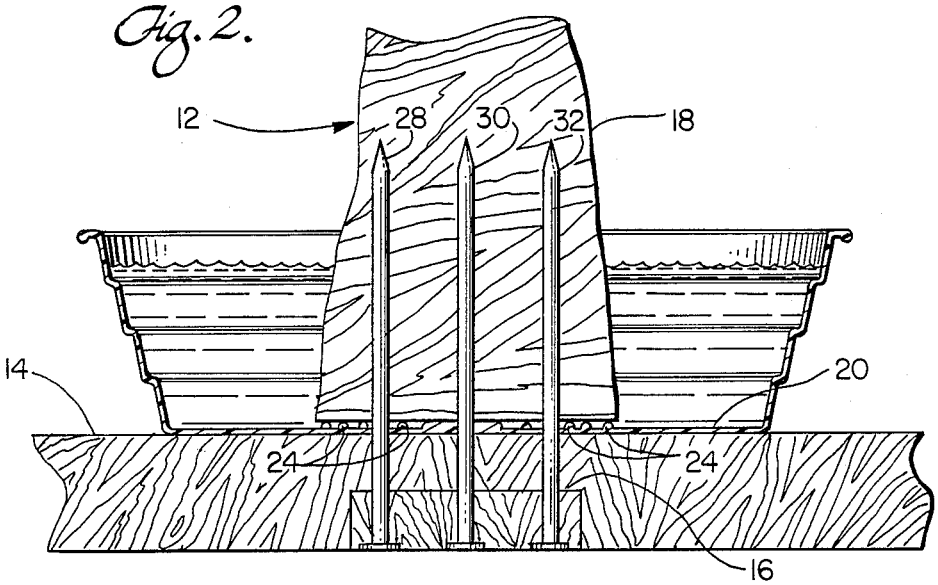
FIG. 2 is a fragmentary semi-schematic cross-section of the embodiment of the invention shown in FIG. 1.

Referring to FIG. 2, details of the method of using the container 10 and the advantages provided by its self-sealing features can be understood. The base of the trunk 18 of the tree 12 is adjacent the inside bottom 20 of the container. The container bottom preferably includes a plurality of ridges 24 (best seen in FIG. 2) which enable water in the container to have access to a greater surface area of the bottom (cut) portion of the tree trunk than would be the case if the container bottom were flat.

The cross-members 14 and 16 (tree support means) are placed adjacent the outside bottom of the container so that at least a portion of the support means is in registry with the bottom of the trunk of the tree. A plurality of fasteners, in this case nails, (only three of which, 28, 30 and 32, are shown) are hammered through the cross-members 14 and 16, the bottom 20 of the container and into the tree trunk 18. The nails are long enough so that the tree and the other members of the assembly (the container and cross-members) are securely held together by the nails after installation. As is described below in greater detail, the material used to form the container seals the openings around the nails to thereby prevent water leakage from the container.

In a preferred embodiment, the container 10 is formed by injection molding a melt blend of ethylene-vinyl acetate (either co-polymer or alloy) and high density polyethylene (HDPE). Preferably, the container composition comprises from about 5% to about 60% by weight ethylene-vinyl acetate with the remainder of the composition being high density polyethylene. If desired other polymers such as low density polyethylene and the like may be added to the blend in an amount that does not adversely affect the self-sealing properties of the container. It has been found that if too little ethylene-vinyl acetate is used (for example, less than about 5% by weight based on the total weight of the ethylene-vinyl acetate/high density polyethylene composition) the resulting container does not have self-sealing characteristics of a high reliability. More preferably, the container composition is from about 10% to about 60% by weight ethylene-vinyl acetate. Conversely, if too much ethylene-vinyl acetate is used, the molding cycle is undesireably long and the container is too flexible. It is also preferred that the ethylene-vinyl acetate used is from about 10% to about 30% by weight vinyl acetate. As conventionally known, the blend can also include extenders, fire retardants, antioxidants, ultraviolet absorbers, fillers, coloring pigments, dyes and plasticzers and the like.

Non-limiting examples of ethylene-vinyl acetate materials that can be used to provide containers in accordance with practice of this invention are a material distributed by U.S. Industrial Chemicals of Anaheim, Calif., identified as UE634 (28% vinyl acetate) and a material manufactured by EXXON Chemical of Baton Rouge, La., identified as LD761.36 (28% vinyl acetate). A non-limiting example of a high density polyethylene material that can be used for blending with the ethylene-vinyl acetate materials for injection molding the container of this invention is identified as T50-3600-119 produced by Soltex Company of Houston, Tex.

While the container is described above as being provided by injection molding, other molding processes such as rotational molding can be used if desired.

The following non-limiting example is set forth to further illustrate the invention.

EXAMPLE 1

A plurality of self sealing containers, such as those shown in FIG. 1, were made by injection molding a composition comprising 50% by weight of the high density polyethylene identified as T50-3600-119 and 50% by weight of the ethylene-vinyl acetate copolymer identified as UE 634.

The containers were pierced with a plurality of nails, and filled with water. There was no water leakage around the nails.

The container 10 provided in accordance with the practice of this invention has a uniform composition, i.e., the entire container is made of the same material. Thus, no matter where the container is punctured, the material will seal the openings around the nails. This is not the case with the containers disclosed in U.S. Pat. No. 3,820,749. For example, only the openings around those nails that pass through the sealant in the cavity at the center of the container disclosed in U.S. Pat. No. 3,820,749 will be sealed. Any nails that pass through the container but do not pass through the sealant will leak. Thus, by using the container 10 of the present invention, even if nails must be driven through the periphery of the container bottom 20 (for example, due to the large size of the trunk or because the trunk is not centered in the container), the openings around the nails will seal to prevent water leakage. Furthermore, the openings around any nails that are through the sidewalls of the container will not leak.

The above descriptions of preferred embodiments of self sealing containers for use in holding a tree erect while supplying the tree with water are for illustrative purposes. Because if variations which will be apparent to those skilled in the art, the present invention is not intended to be limited to the particular embodiments described above. The scope of the invention is defined in the following claims.

What is claimed is:

1. A self sealing container for use in holding a tree erect while supplying said tree with water, the container comprising a blend of ethylene-vinyl acetate and high density polyethylene.

2. The self sealing container according to claim 1 wherein the blend comprises from about 5% to about 60% by weight ethylene-vinyl acetate.

3. The self sealing container according to claim 1 wherein the ethylene-vinyl acetate includes from about 10% to about 30% by weight vinyl acetate.

4. The self sealing container according to claim 1 wherein the blend comprises from about 5% to about 60% by weight ethylene-vinyl acetate and said ethylene vinyl acetate includes from about 10% to about 30% by weight vinyl acetate.

5. A self sealing container for use in holding a tree erect while supplying said tree with water, the container consisting essentially of a blend consisting essentially of ethylene-vinyl acetate and high density polyethylene.

6. The self sealing container according to claim 5 wherein the blend includes from about 5% to about 60% by weight ethylene-vinyl acetate.

7. The self sealing container according to claim 5 wherein the ethylene-vinyl acetate includes from about 10% to about 30% by weight vinyl acetate.

8. The self sealing container according to claim 5 wherein the blend includes from about 5% to about 60% by weight ethylene-vinyl acetate and said ethylene-vinyl acetate includes from about 10% to about 30% by weight vinyl acetate.

9. A method for forming a self sealing container for use in holding a tree erect while supplying the tree with water, the method comprising the steps of molding the self sealing container from a polymeric composition comprising a blend of ethylene-vinyl acetate and high density polyethylene.

10. The method according to claim 9 wherein the blend comprises from about 5% to about 60% by weight ethylene-vinyl acetate.

11. The method according to claim 9 wherein the ethylene-vinyl acetate includes from 10% to about 30% by weight vinyl acetate.

12. The method according to claim 9 wherein the blend comprises from about 5% to about 60% by weight ethylene-vinyl acetate and said ethylene-vinyl acetate includes from about 10% to about 30% by weight vinyl acetate.

13. A method for mounting a tree onto a stand which has the ability to hold the tree erect while supplying the said tree with water, the method comprising the steps of:

(a) providing a container that comprises a blend of ethylene-vinyl acetate and high density polyethylene;

(b) placing the bottom of the trunk of said tree adjacent the inside bottom of the container;

(c) placing tree support means adjacent the outside bottom of the container so that at least a portion of said tree support means is in registry with the tree trunk bottom; and (d) driving at least one elongated fastener through the tree support means, through the container bottom and into the tree trunk, so that the tree is securely fastened to the container and tree support means.

14. The method according to claim 13 wherein the blend comprises from about 5% to about 60% by weight ethylene-vinyl acetate.

15. The method according to claim 13 wherein the ethylene-vinyl acetate includes from about 10% to about 30% by weight vinyl acetate.

16. The method according to claim 13 wherein the blend comprises from about 5% to about 60% by weight ethylene-vinyl acetate and said ethylene-vinyl acetate includes from about 10% to about 30% by weight vinyl acetate.

* * * * *